US008020384B2

(12) United States Patent
Pelletier et al.

(10) Patent No.: US 8,020,384 B2
(45) Date of Patent: Sep. 20, 2011

(54) FUEL INJECTOR NOZZLE WITH MACROLAMINATE FUEL SWIRLER

(75) Inventors: Robert R. Pelletier, Chardon, OH (US); Michael P. Wrubel, Westlake, OH (US); Michael K. Teter, Madison, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 765 days.

(21) Appl. No.: 12/140,002

(22) Filed: Jun. 16, 2008

(65) Prior Publication Data

US 2008/0308654 A1 Dec. 18, 2008

Related U.S. Application Data

(60) Provisional application No. 60/943,920, filed on Jun. 14, 2007.

(51) Int. Cl.
*F02C 7/22* (2006.01)

(52) U.S. Cl. ..... 60/740; 60/742; 60/748; 239/494

(58) Field of Classification Search ..... 60/734, 60/739, 740, 742, 746, 747, 800, 804; 239/494, 239/533.2
See application file for complete search history.

(56) References Cited

U.S. PATENT DOCUMENTS 5,036,657 A * 8/1991 Seto et al. ..... 60/39.281
5,435,884 A 7/1995 Simmons et al.
5,740,967 A 4/1998 Simmons et al.
5,951,882 A 9/1999 Simmons et al.
6,076,356 A 6/2000 Pelletier
6,276,141 B1 8/2001 Pelletier
6,321,541 B1 11/2001 Wrubel et al.
6,427,447 B1 8/2002 Sowa
6,523,350 B1 2/2003 Mancini et al.
6,672,066 B2 * 1/2004 Wrubel et al. ..... 60/740
6,711,898 B2 3/2004 Laing et al.
6,718,770 B2 * 4/2004 Laing et al. ..... 60/740
6,935,117 B2 8/2005 Cowan
7,028,483 B2 4/2006 Mansour et al.

* cited by examiner

*Primary Examiner* — Ehud Gartenberg
*Assistant Examiner* — Steven Sutherland
(74) *Attorney, Agent, or Firm* — Renner, Otto, Boiselle & Sklar, LLP

(57) ABSTRACT

A fuel injector nozzle for dispensing fuel in the combustion chamber of a gas turbine engine, comprises a fluid feed conduit having at least one internal channel for the passage of fluid from an inlet end to an outlet end of the fluid feed conduit. The fluid feed conduit has a first annular segment receiving fluid from the inlet end and a second annular segment fluidly connected to receive fluid from the first annular segment at a junction having a circumferential length less than the circumferential lengths of the first and second annular segments. The second annular segment includes fluid dispensing openings to dispense fluid from the conduit, and the first and second annular segments are coaxial and axially separated for relative movement over a major portion of the second segment to accommodate differential thermal expansion.

17 Claims, 8 Drawing Sheets

FUEL INJECTOR NOZZLE WITH MACROLAMINATE FUEL SWIRLER

RELATED APPLICATION

The present application claims priority to U.S. Provisional Application No. 60/943,920 filed Jun. 14, 2007, which is hereby incorporated herein by reference.

FIELD OF THE INVENTION

The present invention relates generally to injectors and nozzles for high temperature applications, and more particularly to fuel injectors and nozzles for gas turbine engines of aircraft.

BACKGROUND

Fuel injectors for gas turbine engines on an aircraft direct fuel from a manifold to a combustion chamber of a combustor. The fuel injector typically has an inlet fitting connected to the manifold for receiving the fuel, a fuel nozzle located within the combustor for spraying fuel into the combustion chamber, and a housing stem extending between and interconnecting the inlet fitting and the fuel nozzle. The housing stem typically has a mounting flange for attachment to the casing of the combustor.

Fuel injectors are usually heat-shielded because of a high operating temperatures arising from high temperature gas turbine compressor discharge air flowing around the housing stem and nozzle. The heat shielding prevents the fuel passing through the injector from breaking down into its constituent components (i.e., "coking"), which may occur when the wetted wall temperatures of a fuel passage exceed 400° F. The coke in the fuel passages of the fuel injector can build up to restrict fuel flow to the nozzle.

Heretofore, injector nozzles have included annular stagnant air gaps as insulation between external walls, such as those in thermal contact with high temperature ambient conditions, and internal walls in thermal contact with the fuel. In order to accommodate differential expansion of the internal and external walls while minimizing thermally induced stresses, the walls heretofore have been anchored at one end and free at the other end for relative movement.

U.S. Pat. No. 6,321,541 discloses an injector configuration including an elongated laminated feed strip that extends through the stem to the nozzle. The laminate feed strip and nozzle are formed from a plurality of plates. Each plate includes an elongated feed strip portion and a nozzle portion. Selectively etching the plates allows multiple fuel circuits, single or multiple nozzle assemblies and cooling circuits to be easily provided in the injector. Like in the previously mentioned injectors, the feed strip has convolutions along its length to accommodate differential thermal expansion arising from the extreme temperatures to which the injector is exposed.

SUMMARY OF THE INVENTION

The present invention provides a novel and unique feed conduit for an injector and particularly a fuel injector for a turbine engine. The feed conduit uniquely accommodates differential thermal expansion in a manner that overcomes one or more drawbacks associated with prior art designs.

According to one aspect of the invention, an injector comprises a fluid feed conduit having at least one internal channel for the passage of fluid from an inlet end to an outlet end of the fluid feed conduit. The fluid feed conduit has a first annular segment receiving fluid from the inlet end and a second annular segment fluidly connected to receive fluid from the first annular segment at a junction having a circumferential length less than the circumferential lengths of the first and second annular segments. The second annular segment includes fluid dispensing openings to dispense fluid from the conduit, and the first and second annular segments are coaxial and axially separated for relative movement over a major portion of the second segment to accommodate differential thermal expansion.

The fluid feed conduit may be made from a plurality of plates bonded together in a stack, and wherein one or more of the plates have one or more passages formed in a surface thereof that form the at least one internal channel between juxtaposed plates.

The second annular segment may form a complete annulus.

The first and second annular segments may have essentially the same diameter.

As is preferred, a feed member extends generally radially from the first annular segment at a location circumferentially offset from the junction between the first and second annular segments. The feed member may be essentially free of convolutions. The feed member may be a tube or an elongated, essentially flat feed strip that has at least one internal flow passage extending along the length thereof. The first and second annular segments and the feed member may be unitary and made from a plurality of plates bonded together in a stack, and one or more of the plates may have one or more passages formed in a surface thereof that form between juxtaposed plates the at least one internal channel and the at least one internal flow passage.

A support stem may surround the feed member, a nozzle tip member or portion thereof may be attached to the support stem and support the second annular segment. The second annular segment may be fixed to the nozzle tip member while the first annular segment may not be.

The first and second annular segments may be formed by bending a flat, multi-layered plate assembly into a annular configuration, and the second annular segment may be circumferentially continuous.

The injector may be integrated into a combustion engine with the nozzle being supported to dispense fuel within the chamber.

According to another aspect of the invention, a method for forming fluid feed conduit for an injector, comprises the steps of: providing a plurality of flat plates, each of the plates having a first elongate section having a middle portion and first and second leg portions extending from the middle portion, a second elongate section having at least one leg portion extending from a middle portion of the first elongate section essentially parallel to the first leg portion of the first elongate section, and a feed strip section extending from the one leg portion of the second elongate section; forming passage-defining grooves in one or more of the flat plates such that the plates, when stacked together in adjacent, surface-to-surface relation with each other, define at least one internal fluid passage from an inlet end in the feed strip section, through the one leg portion of the second elongate section, and to at least one discharge orifice in the first elongate section; bonding the plates together in adjacent, surface-to-surface contact with one another; and bending the first and second elongate portions to form respective annular segments.

According to a further aspect of the invention, a fluid feed conduit for an injector comprises at least one internal channel for the passage of fluid from an inlet end to an outlet end of the fluid feed conduit, the fluid feed conduit having a first annular segment receiving fluid from the inlet end and a second annular segment fluidly connected to receive fluid from the first annular segment at a junction having a circumferential length less than the circumferential lengths of the first and second annular segments, and wherein the second annular segment includes fluid dispensing openings to dispense fluid from the conduit, and the first and second annular segments are axially separated for relative movement over a major portion of the second segment to accommodate differential thermal expansion.

Further features and advantages of the present invention will become apparent to those skilled in the art upon reviewing the following specification and attached drawings.

DETAILED DESCRIPTION

As above indicated, the principles of the present invention have particular application to fuel injectors and nozzles for gas turbine engines and thus will be described below chiefly in this context. It will of course be appreciated, and also understood, that the principles of the invention may be useful in other applications including, in particular, other fuel nozzle applications and more generally applications where a fluid is injected by a nozzle especially under high temperature conditions.

Figure 1:
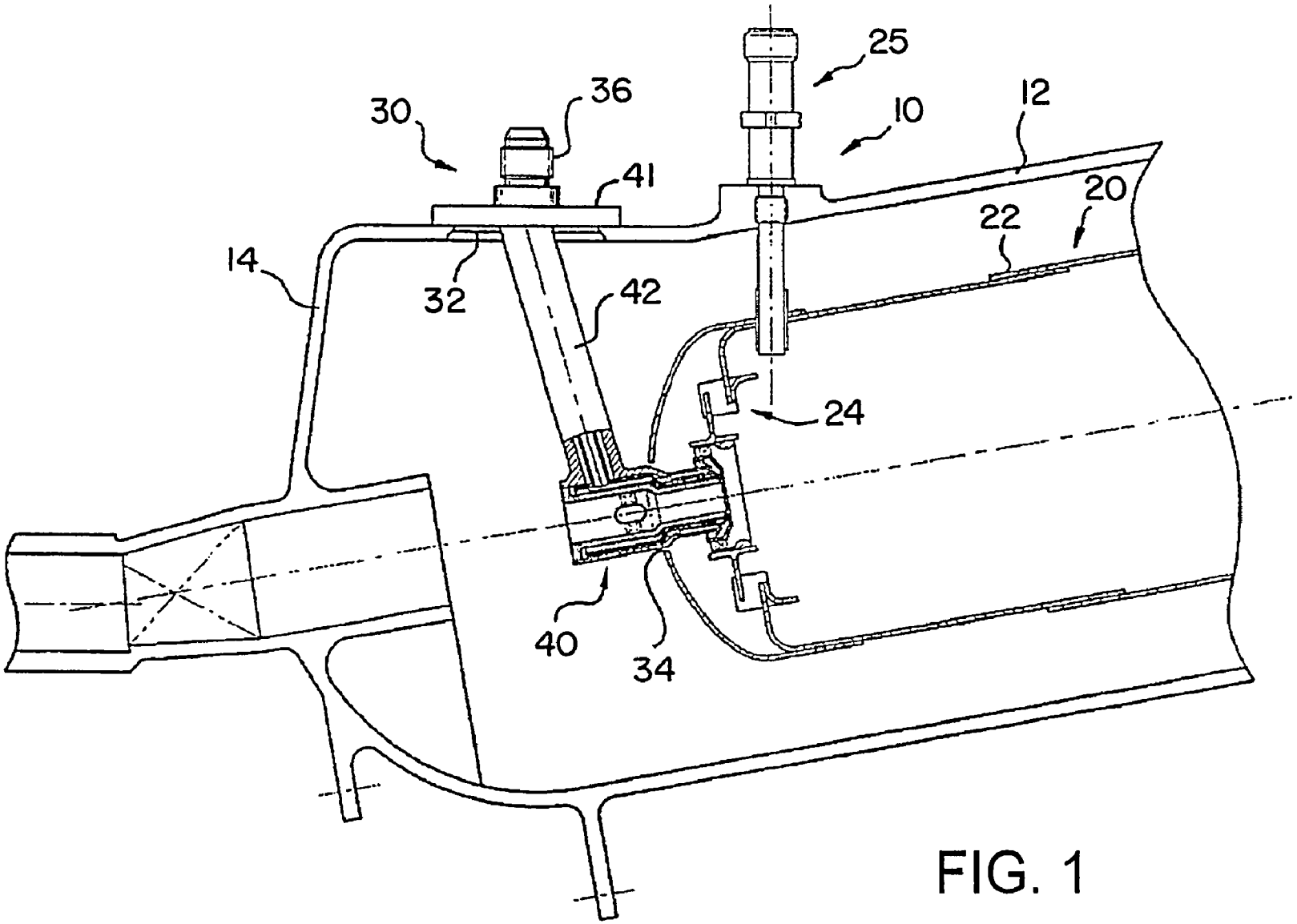
FIG. 1 is a partial cross-sectional view of a portion of an exemplary gas turbine engine, illustrating a fuel injector of the type disclosed in U.S. patent application Ser. No. 11/625,539.

Referring now in detail to the drawings and initially to FIG. 1, a gas turbine engine for an aircraft is illustrated generally at 10. The gas turbine engine 10 includes an outer casing 12 extending forwardly of an air diffuser 14. The casing and diffuser enclose a combustor, indicated generally at 20, for containment of burning fuel. The combustor 20 includes a liner 22 and a combustor dome, indicated generally at 24. An igniter, indicated generally at 25, is mounted to the casing 12 and extends inwardly into the combustor for igniting fuel. The above components can be conventional in the art and their manufacture and fabrication are well known.

A fuel injector, indicated generally at 30, is received within an aperture 32 formed in the engine casing 12 and extends inwardly through an aperture 34 in the combustor liner 22. The fuel injector 30 includes a fitting 36 exterior of the engine casing for receiving fuel, as by connection to a fuel manifold or line; a fuel nozzle, indicated generally at 40, disposed within the combustor for dispensing fuel; and a housing stem 42 interconnecting and structurally supporting the nozzle 40 with respect to fitting 36. The fuel injector is suitably secured to the engine casing, as by means of an annular flange 41 that may be formed in one piece with the housing stem 42 proximate the fitting 36. The flange extends radially outward from the housing stem and includes appropriate means, such as apertures, to allow the flange to be easily and securely connected to, and disconnected from, the casing of the engine using, as by bolts or rivets.

The fuel injector 30 shown in FIG. 1 is of the type disclosed in U.S. patent application Ser. No. 11/625,539. In accordance with the invention, such fuel injector may be replaced by a fuel injector of the type shown in FIG. 2. For ease of description, the same reference numerals will be used to denote corresponding components.

Figure 2:
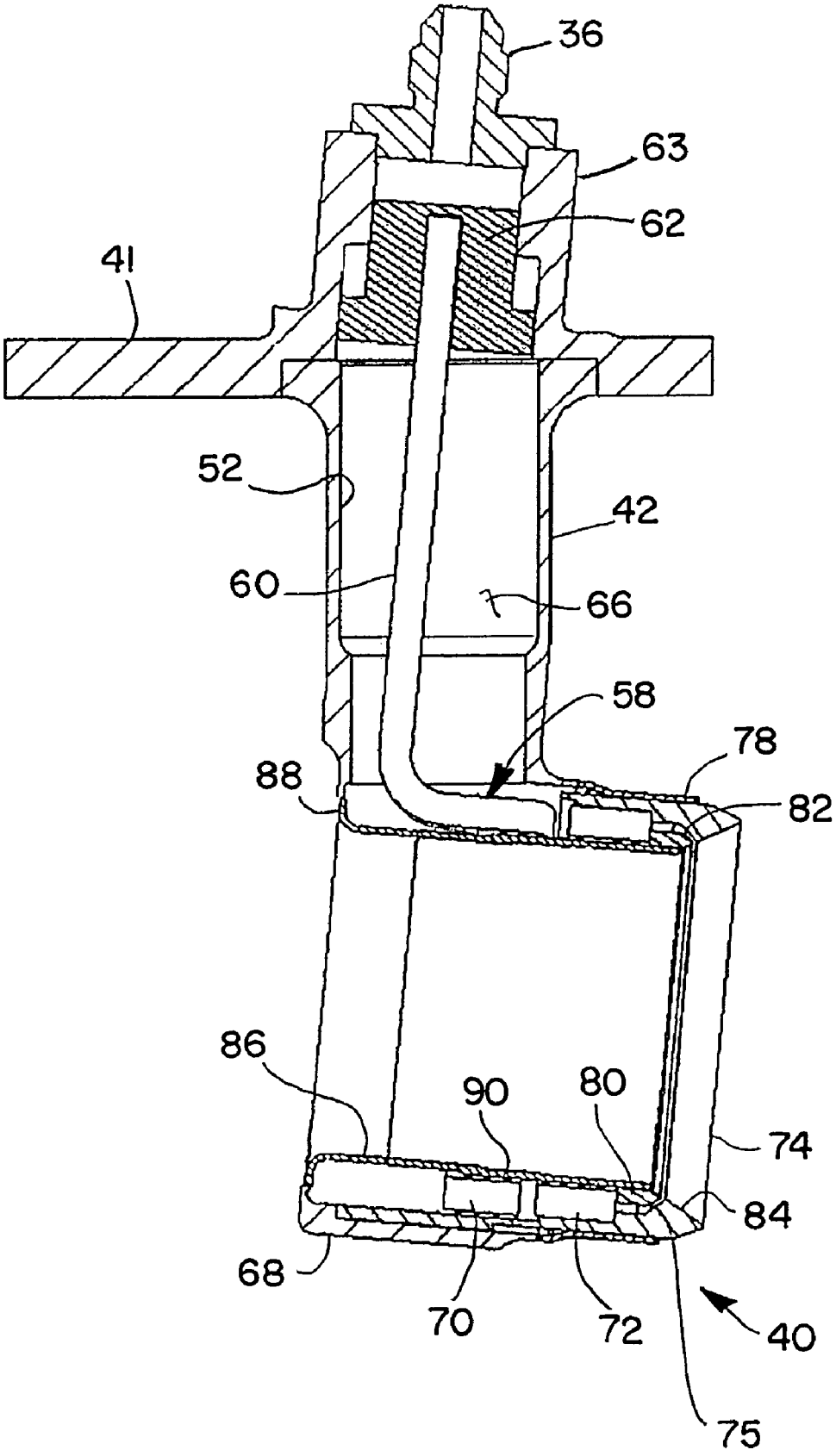
FIG. 2 is a cross-sectional view of an exemplary fuel injector according to the present invention.

As best seen in FIG. 2 when viewed in conjunction with FIG. 1, the housing stem 42 includes an interior bore or passage 52 extending the length of the housing stem. A fuel feed conduit 58 has a fuel feed member or portion 60 that extends through the passage 52. The inlet end of the fuel feed member is secured in an inlet adapter 62 that is sealed to and fixed in a tubular portion of a mounting member 63 including the mounting flange 41. Any suitable seal, such as brazing, may be used to seal the inlet adaptor to the tubular end portion of the mounting member 63.

An annular insulating gap 66 is provided between the exterior surface of the feed portion 60 and the walls of the housing stem 42. The insulating gap 66 provides thermal protection for the fuel in the fuel feed portion. The housing stem 42 has a thickness sufficient to support the nozzle 40 in the combustor when the injector is mounted to the engine, and is formed of material appropriate for the particular application. In the illustrated embodiment, the lower end of the housing stem is unitary with a tubular nozzle housing 68.

The feed conduit 58 further has an annular feed segment 70 receiving fluid from the feed member 60 and an annular nozzle segment 72 fluidly connected to receive fluid from the annular feed segment. The forward or downstream end of the annular nozzle segment is received in an annular recess in a tubular nozzle tip member 74. The nozzle tip member has an outer tubular prefilmer 75 to which the annular nozzle segment 72 is attached as by brazing, and an inner tubular prefilmer 80. The inner prefilmer 80 is attached to the front or downstream face of the annular nozzle segment 72 or may be unitary with the annular nozzle segment 72. The outer prefilmer 75 is attached to the nozzle housing 68 and is surrounded partway by an outer air swirler, only the inner tubular wall of which is shown at 78. The nozzle tip member 74 has located interiorly thereof between the inner and outer prefilmers an annular passage 82 that receives fuel from the annular nozzle segment 72 and directs it into an airstream flowing through the interior of the nozzle 40. As shown, the passage has an axially extending upstream portion and a radially inwardly inclined downstream portion terminating at a tapered end face 84 of the nozzle tip member 74 for directing the fluid radially inwardly into the air stream.

As further seen in FIG. 2, an inner heat shield 86 may be provided interiorly of the annular feed and nozzle segments 70 and 72. The heat shield may have a radially outwardly extending flange 88 for attachment to a back end of the nozzle housing 68. The downstream end of the heat shield may be spaced from or supported with a slip fit in an interior bore in the inner prefilmer 80. The heat shield may be radially inwardly spaced apart from the annular feed and nozzle segments to form an insulating gap 90.

Figure 3:
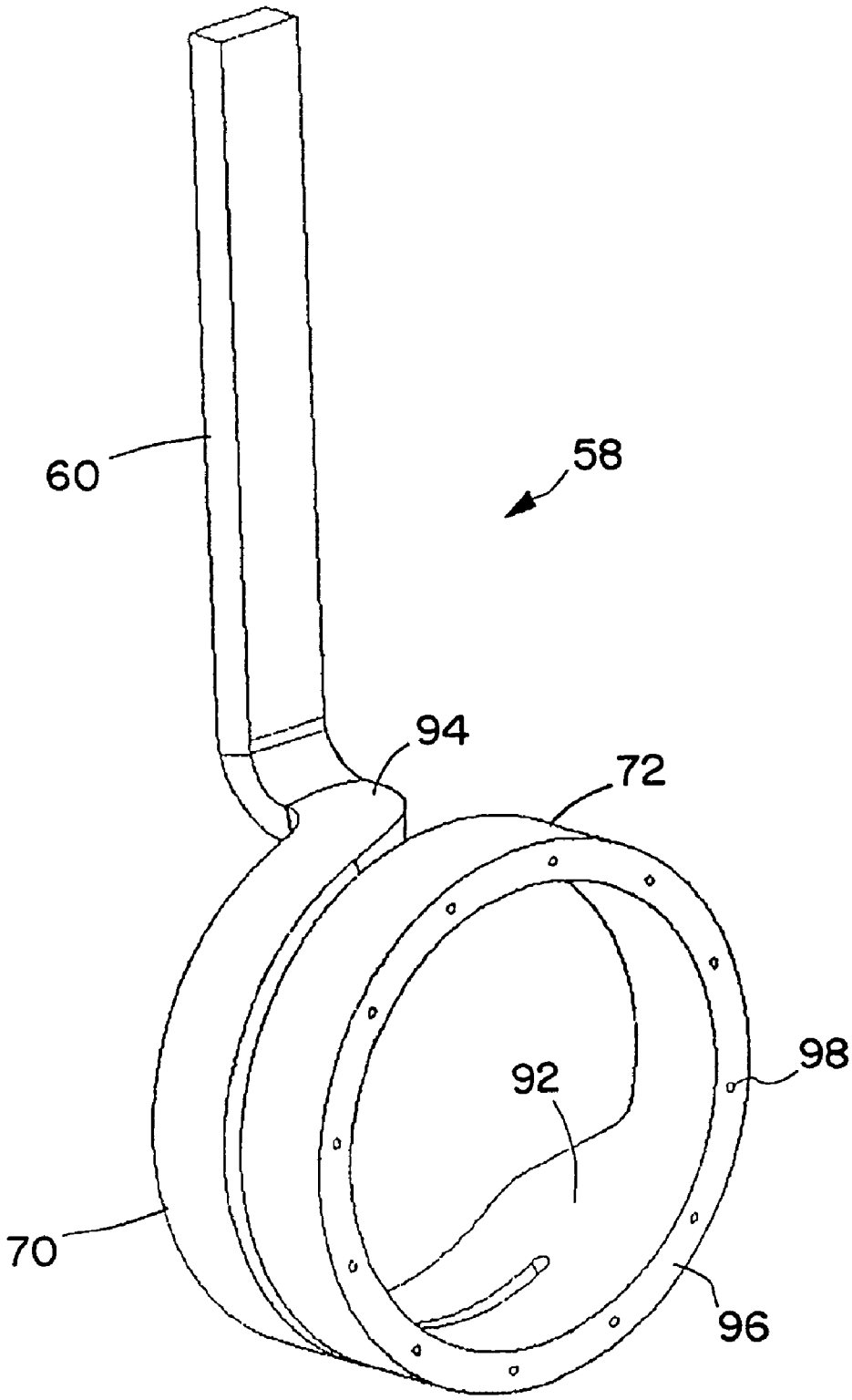
FIG. 3 is a perspective view of an exemplary macrolaminate fuel swirler used in the fuel injector of FIG. 2.
Figure 4:
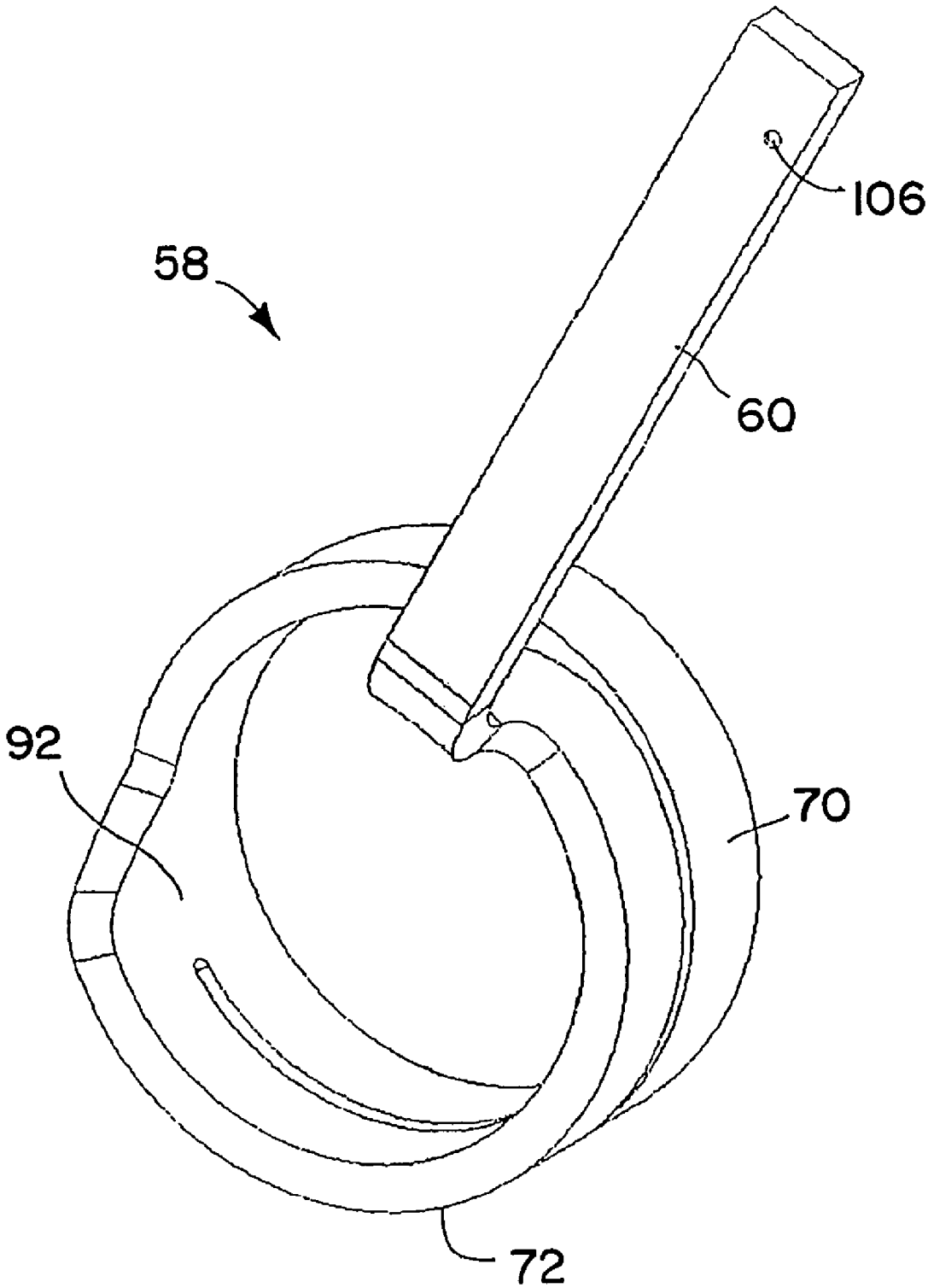
FIG. 4 is another perspective view of the exemplary macrolaminate fuel swirler of FIG. 3.

In FIGS. 3 and 4, the feed conduit 58 is shown separate from the other components of the injector. As shown, the annular feed and nozzle segments 70 and 72 are coaxial and axially separated for relative movement over a major portion of the second segment to accommodate differential thermal expansion. The annular nozzle segment 72 is only connected to the annular feed segment 70 at a junction 92 that has a circumferential length less than the circumferential lengths of the annular feed and nozzle segments. The junction 92 is circumferentially offset from the inlet end 94 of the annular feed segment from which the feed portion 60 extends generally radially.

In the illustrated embodiment, the annular nozzle segment 72 forms a complete cylindrical annulus and has in an axial end face 96 thereof a plurality of fluid dispensing passages 98 for dispensing fluid from the feed conduit 58. In particular, the fluid dispensing passages 98 are arranged to dispense fluid into the passages 82 in the nozzle tip formed by the nozzle tip member 74 and flow guide member 80. The fluid dispensing passages may be inclined to the axis of the nozzle to impart a swirling motion to the fuel. Although the fluid dispensing passages are shown only at an axial end of the annular nozzle segment, they may be otherwise located such as at the radially inner and/or outer surfaces of the annular nozzle segment.

The annular feed segment 70 in the illustrated feed conduit has essentially the same diameter as the annular nozzle segment 72 but an arcuate length about half or slightly more than half of the arcuate length of the annular nozzle segment. Consequently, the junction 92 is located almost diametrically opposite the feed portion. Preferably the arcuate length of the annular feed segment is more than half the arcuate length of the annular nozzle portion, i.e. more than 180 degrees in the illustrated embodiment, to afford adequate accommodation of differential thermal expansion both axial as well as radially. That is, the annular nozzle segment that is attached to and/or supported by the nozzle tip member or a portion thereof attached to the stem, can move axially relative to the end of the feed portion that is attached to the inlet fitting end of the stem.

The separation of the annular feed segment 70 from the annular nozzle segment 72 enable the use of a feed portion 60 that need not be provided with convolutions as were used in the past, although the feed portion could be bowed or provided with convolutions in some applications. The elimination of the convolutions, among other things, simplifies manufacture of the feed conduit.

The feed conduit 58 may be made in any suitable manner. For example, the feed conduit may be assembled from various components including intermitting tubular pieces, as in the manner described in U.S. patent application Ser. No. 11/625,539. Alternatively, the feed conduit may be a macrolaminate made from a plurality of stacked plates that have grooves formed in the surfaces thereof to form flow passages for fuel, coolant, or other fluid in any of a variety of patterns optimized for particular applications, as in the manner described in U.S. Pat. No. 6,321,541, which is hereby incorporated herein by reference.

Figure 5:
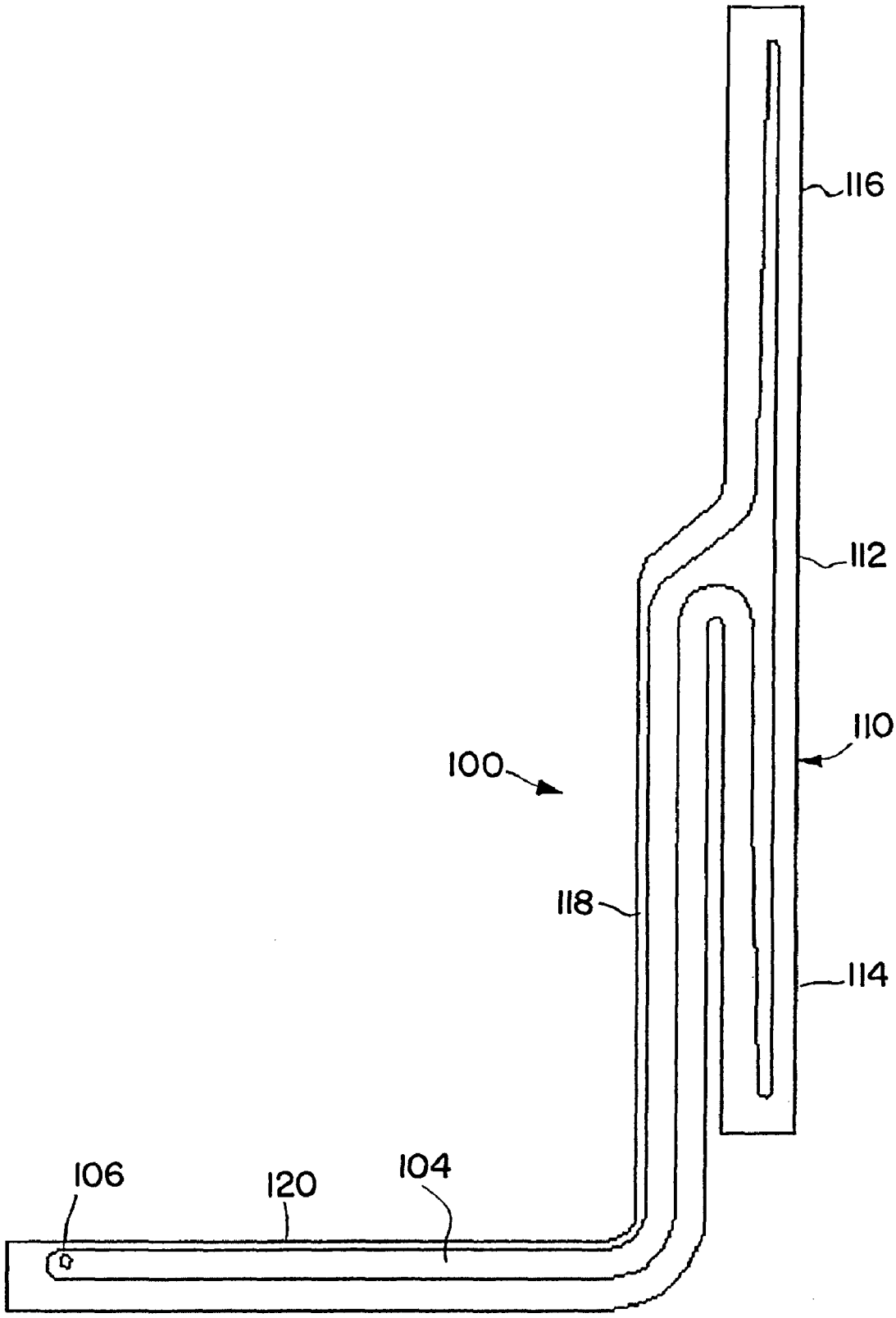
FIG. 5 is a plan view of the inner surface of a plate used to form the fuel swirler of FIGS. 3 and 4.
Figure 6:
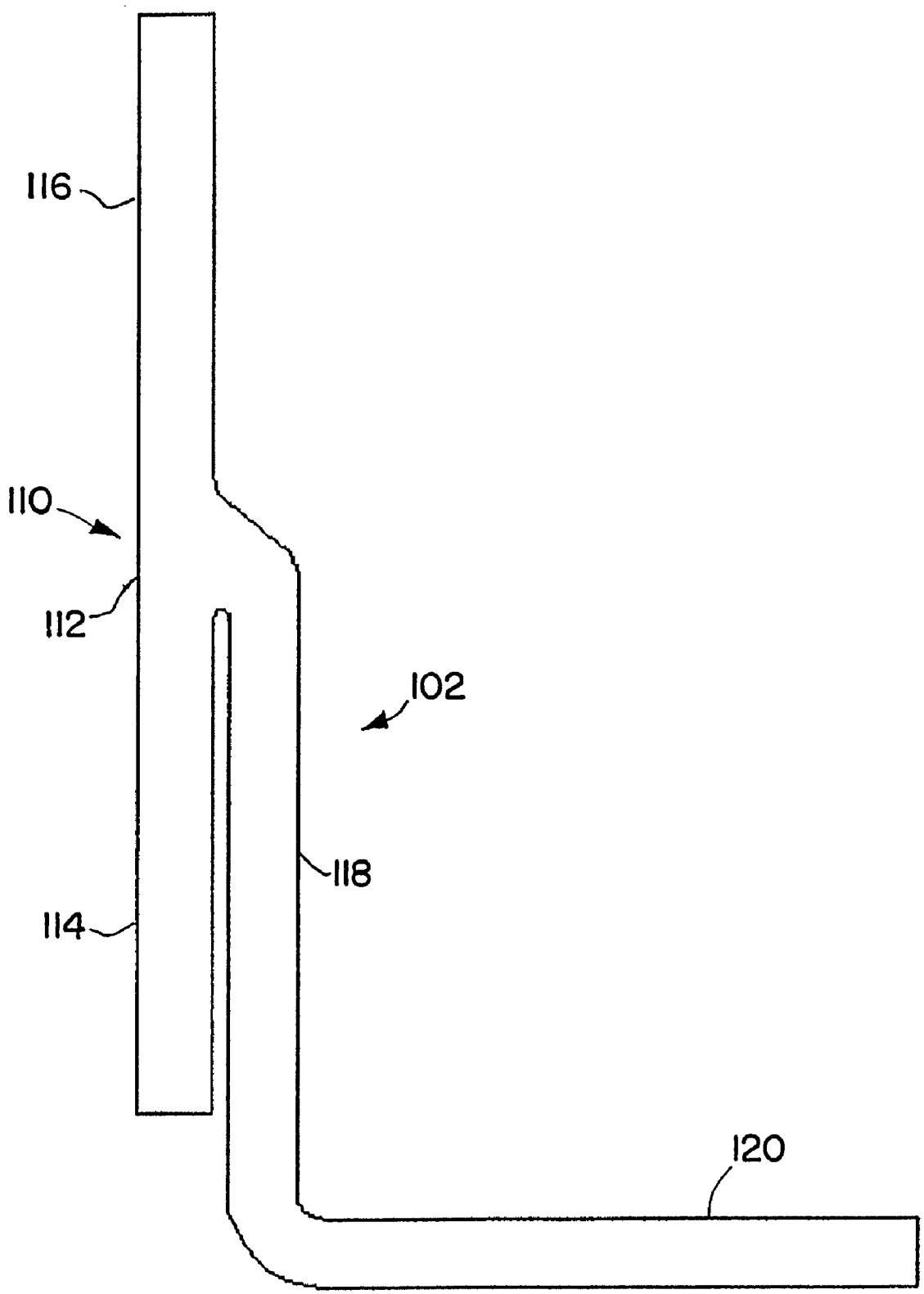
FIG. 6 is a plan view of the inner surface of another plate used to form the fuel swirler of FIGS. 3 and 4.

In the illustrated embodiment, the fluid feed conduit 58 is made from a plurality of plates bonded together in a stack. For simplicity's sake, only two plates are shown, and one or both of the plates have one or more passages formed in a surface thereof that form at least one internal channel between juxtaposed plates for delivering fluid from the inlet end of the fluid feed conduit to the fluid dispensing passages. As seen in FIGS. 5 and 6, one plate 100 has a groove 104 formed in an internal surface thereof while the internal surface of the other plate 102 simply functions to close the open side of the groove when the plates are bonded or otherwise secured together with the internal surfaces abutting one another. As seen in FIGS. 4 and 5, the plate 100 further has an inlet opening 106 at the inlet end thereof for flow of fluid into the interior flow passage from the inlet fitting (FIG. 2). The fluid dispensing passages 98 (FIG. 3) may be formed by grooves or holes in one or both of the plates, or such passages may be formed, as by drilling or electric discharge machining, after the plates have been joined together.

The plates 100 and 102 may be relatively thin (e.g., 0.005-0.2 inches thick) and flat. The plates are each preferably formed in one piece from a metal sheet of an appropriate material such as INCONEL 600, and can be formed in the desired configuration by durable etching, stamping, machining, electro-discharge machining, or die-cutting. While two plates are illustrated and described, it is of course possible that a greater number of plates could be provided, and that the shape of the individual plates may be other than as illustrated. It is also possible that the feed portion, annular feed segment and/or annular nozzle segment could be formed separately and then later attached together. However, to reduce the number of individual components and manufacturing and assembly steps, it is preferred that these components be formed together (unitarily) from one-piece plates.

The flow passage or passages can be formed in any appropriate manner, such as, for example by etching. Chemical etching of such plates is well known to those skilled in the art, and is described for example in U.S. Pat. No. 5,435,884, which is hereby incorporated by reference. The etching of the plates allows the forming of very fine, well-defined and complex grooves and openings, which can allow multiple fuel circuits to be provided while maintaining a small cross-section for the feed conduit.

The plates 100 and 102 can be joined together in any suitable manner, as by a bonding process such as brazing or diffusion bonding. Such bonding processes are well-known to those skilled in the art, and provide a very secure connection between the plates. Diffusion bonding is particularly useful, as it causes boundary cross-over (atom interchange) between the adjacent layers. Diffusion bonding is provided through appropriate applications of heat and pressure, typically under an applied vacuum in an inert atmosphere. A more detailed discussion of diffusion bonding can be found, for example, in U.S. Pat. No. 5,484,977; U.S. Pat. No. 5,479,705; and U.S. Pat. No. 5,038,857, among others.

As shown in FIGS. 5 and 6, each of the plates has an elongate nozzle section 110 having a middle portion 112 and opposite leg portions 114 and 116 extending from the middle portion, an elongate feed section 118 having at least one leg portion extending from the middle portion 112 of the elongate nozzle section 110 essentially parallel to the leg portion 114 of the elongate nozzle section, and a feed strip section 120 extending at an incline (e.g. right angle) to the leg portion 118 of the elongate feed section. After the plates are brought together in adjacent, surface-to-surface contact with one another, they are joined together as by bonding. The elongate nozzle and feed portions are then bent to form the annular nozzle and feed segments, and the joined feed strip sections are bent relative to the elongate feed portions.

As shown in FIG. 3, the feed and nozzle portions 70 and 72 are formed into an arcuate, preferably circular, configuration. This can be accomplished using appropriate equipment, for example, a cylindrical mandrel or other appropriately-shaped tool. The bonding process (such as brazing or diffusion bonding) maintains the various plates in fixed relation with respect to one another during this forming step if the forming step is done prior to the mechanical deformation step, as will usually be the case. The ends of the arm portions 114 and 116 of the elongate nozzle portions 110 may be joined together by an appropriate process such as brazing or welding to form a continuously cylindrical annular nozzle segment, or the ends could be spaced apart from each other. The plates could also be formed into shapes other than circular/cylindrical, or even provided without forming, for some applications.

Figure 7:
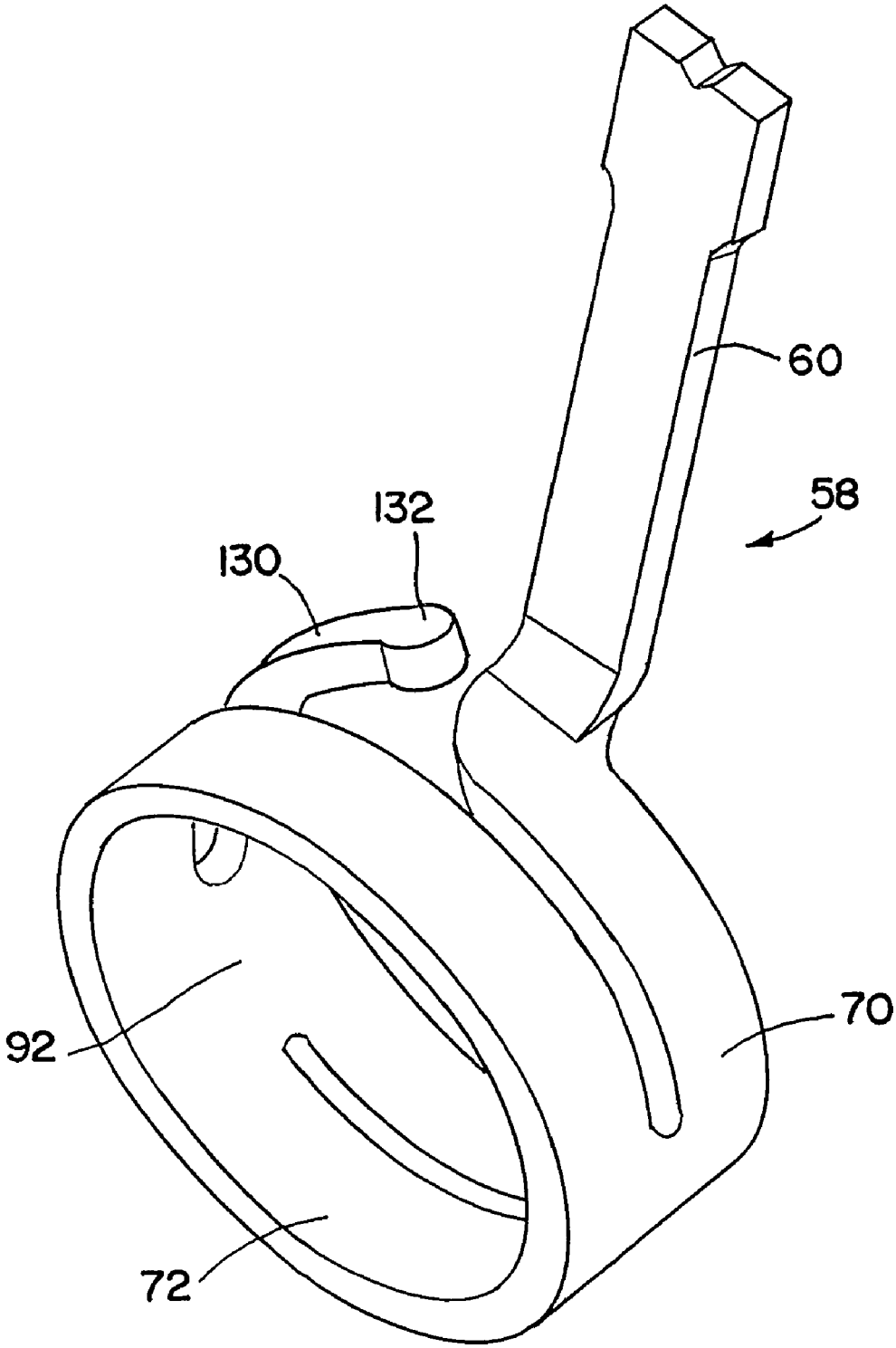
FIG. 7 is a perspective view of another exemplary macrolaminate fuel swirler.

Referring now to FIG. 7, the feed conduit may be configured for providing fluid to another injector nozzle such as a pilot nozzle or to another nozzle assembly. This can be readily accomplished, for example, by providing an arcuate secondary feed segment 130, that may be formed as a continuation of the annular feed segment extending beyond the junction 92. This secondary feed segment may be terminated at a mounting pad 132 whereat another feed conduit can be attached to supply fluid from the feed conduit to another nozzle or nozzle assembly (not shown). Of course, suitable interior passage or passages and an outlet opening or openings will be provided for effecting the flow of fluid from one feed conduit to the other.

Figure 9:
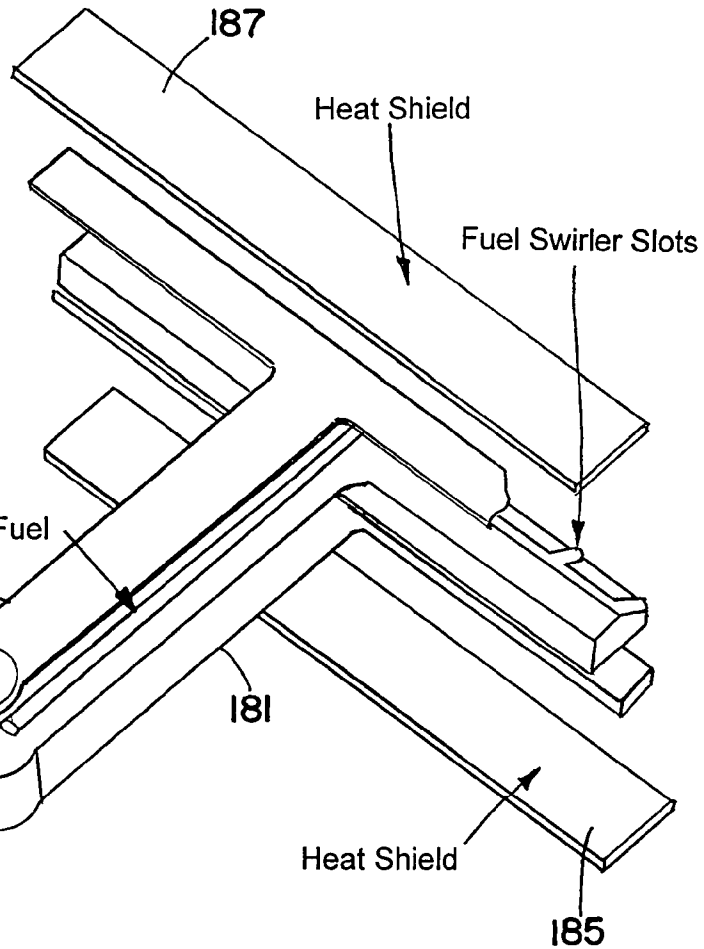
FIG. 9 is an exploded perspective view of the plates used to form the fuel swirler of FIG. 8.
Figure 8:
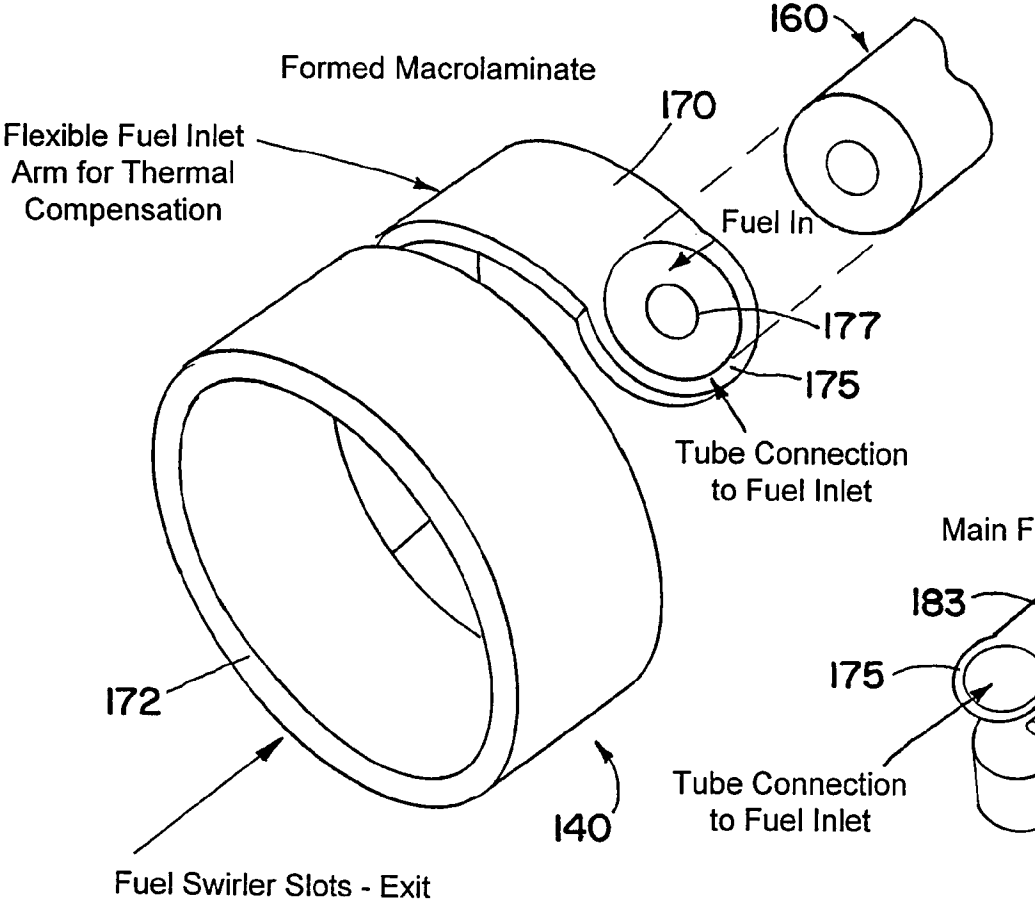
FIG. 8 is a perspective view of a further exemplary macrolaminate fuel swirler.

Turning now to FIGS. 8 and 9, another exemplary feed conduit 140 is shown. In this embodiment, the annular feed and nozzle segments 170 and 172 are formed essentially as above described. The feed portion, however, is formed by a tubular member 160 that is attached by suitable means, such as brazing or welding, to a pad-like attachment end portion 175 of the annular feed segment at its inlet end. The attachment portion may be recessed to receive the end of the feed tube 160 and provided with an inlet opening 177 for receiving fuel from the feed tube. As seen in FIG. 9, the plates 181 and 183 used to form the annular feed and nozzle segments may be T-shape, with the stem of the T being bent to the configuration shown in FIG. 8. Heat shields 185 and 187 may also be provided as illustrated.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An injector comprising a fluid feed conduit having at least one internal channel for the passage of fluid from an inlet end to an outlet end of the fluid feed conduit, the fluid feed conduit having a first annular segment receiving fluid from the inlet end and a second annular segment fluidly connected to receive fluid from the first annular segment at a junction having a circumferential length less than the circumferential lengths of the first and second annular segments, and wherein the second annular segment includes fluid dispensing openings to dispense fluid from the conduit, and the first and second annular segments are axially separated for relative movement over a major portion of the second segment to accommodate differential thermal expansion.

2. An injector as set forth in claim 1, wherein the fluid feed conduit is made from a plurality of plates bonded together in a stack, and wherein one or more of the plates have one or more passages formed in a surface thereof that form the at least one internal channel between juxtaposed plates.

3. An injector as set forth in claim 2, wherein the second annular segment forms a complete annulus.

4. An injector as set forth in claim 2, wherein the first and second annular segments are coaxial and have essentially the same diameter.

5. An injector as set forth in claim 1, wherein a feed member extends generally radially from the first annular segment at a location circumferentially offset from the junction between the first and second annular segments.

6. An injector as set forth in claim 5, wherein the feed member is essentially free of convolutions.

7. An injector as set forth in claim 5, wherein the feed member is a tube.

8. An injector as set forth in claim 5, wherein the feed member is an elongated, essentially flat feed strip that has at least one internal flow passage extending along the length thereof.

9. An injector as set forth in claim 8, wherein the first and second annular segments and the feed member are unitary and made from a plurality of plates bonded together in a stack, and wherein one or more of the plates have one or more passages formed in a surface thereof that form between juxtaposed plates the at least one internal channel and the at least one internal flow passage.

10. An injector as set forth in claim 5, comprising a support stem surrounding the feed member.

11. An injector as set forth in claim 5, comprising a support stem surrounding the feed member, and a nozzle tip member attached to the support stem and supporting the second annular segment.

12. An injector as set forth in claim 11, wherein the second annular segment is fixed to the nozzle tip member and the first annular segment is not.

13. An injector as set forth in claim 1, wherein the first and second annular segments are formed by bending a flat, multi-layered plate assembly into a annular configuration.

14. An injector as set forth in claim 13, wherein the second annular segment is circumferentially continuous.

15. A combustion engine including an injector as set forth in claim 1, and a combustion chamber, the nozzle being supported in the combustion chamber to dispense fuel within the chamber.

16. An injector as set forth in claim 1, wherein the first and second annular segments are axially spaced apart at room temperature.

17. A fluid feed conduit for an injector, comprising at least one internal channel for the passage of fluid from an inlet end to an outlet end of the fluid feed conduit, the fluid feed conduit having a first annular segment receiving fluid from the inlet end and a second annular segment fluidly connected to receive fluid from the first annular segment at a junction having a circumferential length less than the circumferential lengths of the first and second annular segments, and wherein the second annular segment includes fluid dispensing openings to dispense fluid from the conduit, and the first and second annular segments are coaxial and axially separated for relative movement over a major portion of the second segment to accommodate differential thermal expansion.

* * * * *